US010085533B2

(12) United States Patent
Xu

(10) Patent No.: US 10,085,533 B2
(45) Date of Patent: Oct. 2, 2018

(54) SUITCASE

(71) Applicant: Zhonglang Xu, Hefei (CN)

(72) Inventor: Zhonglang Xu, Hefei (CN)

( * ) Notice: Subject to any disclaimer, the term of this patent is extended or adjusted under 35 U.S.C. 154(b) by 168 days.

(21) Appl. No.: 15/172,319

(22) Filed: Jun. 3, 2016

(65) Prior Publication Data

US 2017/0188677 A1 Jul. 6, 2017

(30) Foreign Application Priority Data

Dec. 30, 2015 (CN) ..... 2015 2 1132259 U

(51) Int. Cl.

| | |
|---|---|
| ***A45C 13/02*** | (2006.01) |
| ***A45C 13/03*** | (2006.01) |
| ***A45C 5/03*** | (2006.01) |
| ***A45C 13/12*** | (2006.01) |
| *A45C 13/10* | (2006.01) |

(52) U.S. Cl.

CPC ..... *A45C 13/02* (2013.01); *A45C 5/03* (2013.01); *A45C 13/03* (2013.01); *A45C 13/123* (2013.01); *A45C 2013/026* (2013.01); *A45C 2013/1015* (2013.01)

(58) Field of Classification Search

CPC ..... A45C 13/02; A45C 5/03; A45C 13/123; A45C 2013/1015

See application file for complete search history.

(56) References Cited

U.S. PATENT DOCUMENTS

| | | | | | |
|---|---|---|---|---|---|
| 343,073 | A * | 6/1886 | Seefels | A45C 13/02 | 190/109 |
| 749,959 | A * | 1/1904 | Curtiss | A45C 13/02 | 190/36 |
| 775,343 | A * | 11/1904 | Anderson | A45C 3/00 | 190/111 |
| 1,081,014 | A * | 12/1913 | Burchess | A45C 13/02 | 190/109 |
| 1,533,494 | A * | 4/1925 | Billburg | A45C 9/00 | 108/34 |
| 4,596,329 | A * | 6/1986 | Eldridge, Jr. | A61B 50/362 | 206/232 |
| 6,286,667 | B1 * | 9/2001 | Lee | G06F 15/02 | 206/305 |

(Continued)

*Primary Examiner* — Tri Mai

(74) *Attorney, Agent, or Firm* — Nixon & Vanderhye PC

(57) ABSTRACT

A suitcase, in cases-and-bags field, comprises case bodies and separating plates. The case bodies include upper and lower case bodies rotationally connected and form a storage chamber; the separating plates include an upper separating plate in the upper case body and a lower separating plate in the lower case body; when the case bodies open, the upper separating plate rotates toward direction of the lower case body, and the lower separating plate rotates toward the upper case body. The storage chamber of the case bodies is divided by added upper and lower separating plates into spaces which are more compact in volume, facilitating fixing luggage. Upper/lower case bodies open and close by rotating, the upper and lower separating plates are respectively rotationally connected in the upper/lower case bodies, and both separating plates can rotate toward the middle, facilitating support and control, making users easily remove/put luggage from/into the storage chamber.

7 Claims, 5 Drawing Sheets

(56) References Cited

U.S. PATENT DOCUMENTS

| | | | | |
|---|---|---|---|---|
| 8,607,947 | B2 * | 12/2013 | Morszeck | A45C 13/02<br>190/109 |
| 2015/0150348 | A1 * | 6/2015 | Wax | A45C 5/03<br>190/18 A |

* cited by examiner

SUITCASE

CROSS-REFERENCE TO RELATED APPLICATION

This application is based on Chinese Patent Application No. 201521132259.8 filed on Dec. 30, 2015, the disclosure of which is incorporated herein by reference in its entirety.

TECHNICAL FIELD

The present application relates to the field of cases and bags, and particularly to a suitcase.

BACKGROUND ART

At present, with the rapid pace of social life and the progress of economy, science, and technology, people travel more frequently. Tourisms, vacation aboard, business trips, friend visiting, off-site learning, home-returning and so on are very common. As more travels are needed, suitcases for storing goods become essential items for people.

The size of the suitcase becomes increasingly large since a lot of luggage items are needed for traveling. When many items are cased, the internal items need to be compressed and fixed. At present, it is a common practice to additionally provide separating plate(s) inside an internal chamber of the suitcase to divide a storage chamber into a plurality of spaces, which can serve a storing function.

The inventor has found from researches that in the prior art, the separating plate is fixed at three points, wherein the separating plate is opened up in a direction from a bottom of a case body to a top of the case body, however, such an opening manner makes the separating plate not supported during the opening process, and the separating plate has to be totally flipped out to be in contact with the ground, causing the separating plate to get soiled. Moreover, such an opening manner is not favorable for a user's operation since the user has to continuously change his/her position with respect to the case body for opening the separating plate and closing the separating plate.

DISCLOSURE OF THE APPLICATION

An object of the present application is to provide a suitcase to improve the storing capacity of a suitcase in the prior art.

The present application is implemented as follows:

a suitcase, comprising case bodies and separating plates, wherein the case bodies comprise an upper case body and a lower case body which are rotationally connected, the upper case body and the lower case body are capable of forming a storage chamber, the separating plates comprise an upper separating plate and a lower separating plate, the upper separating plate is provided in the upper case body, and the lower separating plate is provided in the lower case body;

in a state of the case bodies being open, the upper separating plate is capable of rotating toward a direction of the lower case body, and the lower separating plate is capable of rotating toward the upper case body.

The storage chamber of the case bodies is divided into several spaces by the added upper separating plate and lower separating plate, and the spaces after the division are more compact in volume, facilitating fixing the luggage. The upper case body and the lower case body are opened and closed by rotating, the upper separating plate and the lower separating plate are respectively rotationally connected in the upper case body and the lower case body, and both separating plates are capable of rotating toward the middle, facilitating the support and control, and making it easy for a user to take out luggage from or put the luggage into the storage chamber.

Further, the separating plate and the case body are connected by a connecting belt set, and there are two connecting belt sets which are respectively connected into the lower case body and the upper case body;

the case body comprises a first sidewall and a second sidewall which are opposite to each other, a rotation center line between the upper case body and the lower case body is provided on the second sidewall, each of the connecting belt sets comprises a first belt set and a second belt set, the separating plate is detachably connected with the first sidewall through the first belt set, and the separating plate is rotationally connected with the second sidewall through the second belt set;

a side of the separating plate far away from the second sidewall is a first side edge and a side of the separating plate close to the second sidewall is a second side edge;

when the first belt set is in a state of being separated from the separating plate, the upper separating plate and the lower separating plate are capable of rotating, and the first side edge of the upper separating plate and the first side edge of the lower separating plate abut against each other during rotation.

By connecting the separating plate with the connecting belt set, rotation of the separating plate is facilitated. The first belt set and the second belt set connect two sides of the separating plate with the first sidewall and the second sidewall respectively. The second sidewall is the region where rotating axes of the lower case body and the lower case body are located, and the first sidewall is a sidewall on the case body directly facing the second sidewall. The upper separating plate and the lower separating plate both are fixed on the case bodies through the connection with the second sidewall and the first sidewall, facilitating removing or installing the separating plates. The upper separating plate and the lower separating plate both can be disconnected from the first belt set and movably connected with the case bodies through the second belt set. When the upper separating plate and the lower separating plate are disconnected from the first belt set, the first side edges of the upper separating plate and the lower separating plate can rotate, and during the rotating process, the first side edges of the upper separating plate and the lower separating plate abut against each other such that the two separating plates can remain erected, with the second sidewall located between the two separating plates. The storage chamber is completely exposed when the two separating plates are erected, making it convenient for the user to put luggage into the upper case body and the lower case body. By such a connection manner, the user can erect or lay down the separating plate without changing his/her position with respect to the suitcase, facilitating operations. Meanwhile, the separating plates will not be flipped away from the storage chamber or be in contact with the ground.

Further, the upper separating plate and the lower separating plate both are detachably connected with the second belt set.

The separating plate and the second belt set also can be detachably connected with each other, making it easy for the user to detach the separating plate to clean the suitcase.

Further, the detachable connection is in a mode of a Velcro connection or button connection.

Velcro and buttons are common modes of detachable connection. The Velcro is easily used and can be used repeatedly, facilitating adjusting the connection position; the button, allowing precise location, is simple in use.

Further, the upper separating plate and the lower separating plate are respectively provided with a loop surface and a hook surface of the Velcro, and when the first side edge of the upper separating plate and the first side edge of the lower separating plate abut against each other, the loop surface and the hook surface are in contact with each other.

The upper separating plate and the lower separating plate are provided with corresponding Velcro. The two separating plates, when abutting against each other to erect, are fixed through adhesion of the loop surface and the hook surface of the Velcro, making it convenient to enable the two separating plates to maintain the erected state.

Further, each of the connecting belt sets further comprises a connecting section, the first belt set and the second belt set are both connected or integrally formed with the connecting section, and the connecting section is used for fixing or compressing luggage.

The connecting section is used for tying the luggage into the suitcase. The luggage is pre-compressed into the storage chamber by the connecting section, and then the luggage is further compressed by the separating plate, preventing small items from moving freely in the storage chamber, at the same time, the utilization ratio of the storage chamber can be improved since the loose and soft luggage is compressed in volume so that the case body is capable of storing more luggage items.

Further, the connecting section is in a shape of a triangle having two endpoints located on the second sidewall and another endpoint located on the first sidewall. The first belt set and the second belt set are fixed at the endpoints respectively.

The triangular area formed by the connecting section is capable of reliably limiting the position of the luggage, and all of the three endpoints of the triangle are located on the second sidewall and the first sidewall so that the connecting section requires a relatively short length.

Further, the connecting belt set is fixed with the case body at three endpoints of the triangle.

The connecting belt set is fixedly connected with the case body only through regions of the three endpoints, such that luggage can be placed and fixed in intermediate sections of the connecting belt sets.

Further, the connecting sections of the two connecting belt sets are respectively provided in a gap between the upper separating plate and the upper case body and a gap between the lower separating plate and the lower case body.

The separating plate and the luggage, located at two sides of the connecting section respectively, do not interfere with each other when putting in the luggage.

Further, the separating plate is in a quadrilateral shape, and four corners of the separating plate are provided with a notch respectively.

Four corners of the separating plate are provided with the notch, facilitating providing the separating plates into the upper case body and the lower case body. Because a joint of the sidewalls of the case bodies may be provided with chamfers or rounded angles and an internal space of the case body may be occupied when universal wheels are provided at the bottom of the case body, all of the four corners of the separating plate are provided with the notch making it easy to be adapted to spatial dimensions.

The beneficial effects of the present application are as follows: a connecting belt set is provided inside the case body and the separating plate is limited by the connecting belt set, making it easy to adjust a position of the separating plate, and it is not needed to remove the separating plate when loading the luggage or taking out the luggage, which is more convenient. The upper case body and the lower case body are opened and closed by rotating, and the upper separating plate and the lower separating plate are respectively connected to the upper case body and the lower case body by the connecting belt sets, making it convenient for the user to take out the luggage from or put the luggage into the storage chamber. Furthermore, the two separating plates, when opened, can be enabled to abut against each other and erect, such that a user can more easily adjust the state of the separating plates.

BRIEF DESCRIPTION OF DRAWINGS

In order to more clearly illustrate technical solutions of embodiments of the present application, drawings which are needed for description of the embodiments will be briefly introduced hereinafter. It should be understood that the drawings below merely show some embodiments of the present application, and therefore should not be construed as limiting the scope. Other relevant drawings can also be obtained, in light of these drawings, by those skilled in the art without paying any inventive effort.

SUMMARY OF REFERENCE SIGNS

Figure 1:
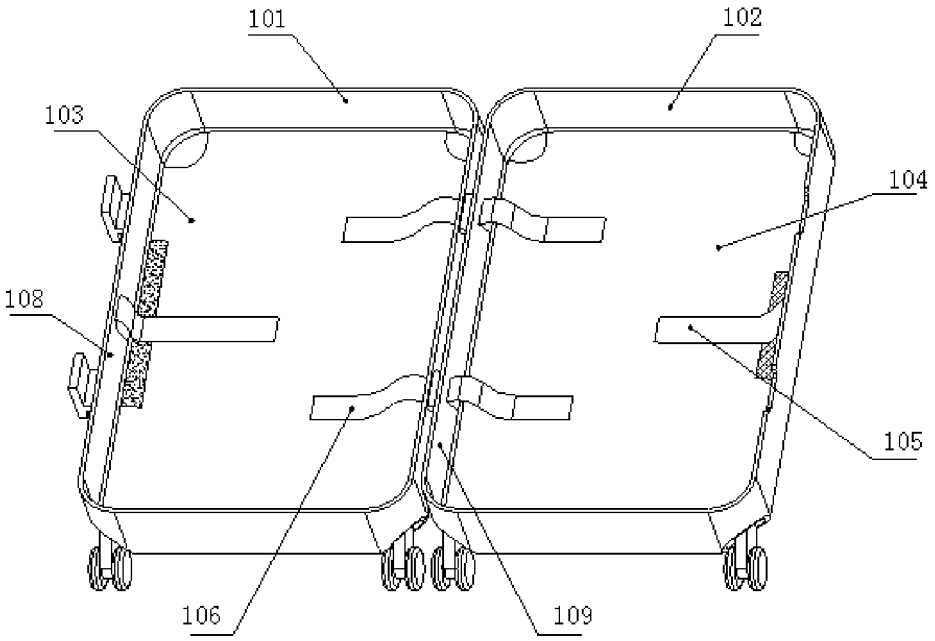
FIG. 1 is a structural schematic diagram of a suitcase provided in Embodiment I of the present application.

101 upper case body; 102 lower case body; 103 upper separating plate; 104 lower separating plate; 105 first belt set; 106 second belt set; 107 connecting section; 108 first sidewall; 109 second sidewall; 110 second side edge; 111 first side edge; 112 notch; 113 Velcro; 114 button.

DETAILED DESCRIPTION OF EMBODIMENTS

In order to make clearer the objects, the technical solutions, and the advantages of embodiments of the present application, the technical solutions in the embodiments of the present application will be described clearly and completely hereinafter, in conjunction with drawings of the embodiments of the present application. Apparently, some but not all of embodiments of the present application are described. Generally, components in the embodiments of the present application which are illustrated and shown in these drawings herein can be arranged and designed in different configurations. Therefore, the following detailed description of the embodiments of the present application provided in the drawings is not intended to limit the scope of protection of the present application, but merely present the selected embodiments of the present application. Based on the embodiments of the present application, all of the other embodiments, which a person ordinarily skilled in the art obtains without paying inventive effort, fall within the scope of protection of the present application.

In the description of the present application, it should be noted that orientational or positional relationships indicated by terms, such as "center", "longitudinal", "lateral", "length", "width", "thickness", "upper", "lower", "front", "back", "left", "right", "vertical", "horizontal", "top", "bottom", "inner", "outer", "clockwise" and "anticlockwise" are based on the orientational or positional relationships as shown in the drawings, merely for facilitating describing the present application, rather than indicating or suggesting that the related devices or elements have to be in the specific orientation or configured and operated in the specific orientation, therefore they shall not be construed as limiting the present application.

In addition, terms "first" and "second" are only used for descriptive purpose, but should not be understood as indicating or suggesting the importance in relativity or implicitly indicating the number of the related technical features. Therefore, if a feature is defined with "first" or "second", explicitly or implicitly there may be one or more such features included. In the description of the present application, "a plurality of" means two or more, unless expressly specified otherwise.

In the description of the present application, terms, such as "arrange", "link", "connect" and "fix", should be broadly interpreted, unless specified and defined otherwise. For example, it may be a fixed connection, a detachable connection, or being integrated; or it may be a mechanical connection or an electrical connection; or it may be a direct connection, an indirect connection through an intermediate medium, or it may be an inner communication between two elements, or interactional relationship between two elements. For those ordinarily skilled in the art, specific meanings of the above terms in the present application can be understood based on specific situations.

In the present application, unless expressly specified and defined otherwise, a first feature being "above" or "below" a second feature can means including the case where the first feature and the second feature are in direct contact, and also the case where the first feature and the second feature are not in direct contact but via another feature therebetween. Furthermore, the first feature being "above", "on" and "over" the second feature means including the case where the first feature is directly above or obliquely above the second feature, or only means that the horizontal height of the first feature is higher than that of the second feature. The first feature being "below", "under" and "underneath" the second feature means including the case where the first feature is directly under or obliquely under the second feature, or only means that the horizontal height of the first feature is lower than that of the second feature.

Embodiment I

Figure 2:
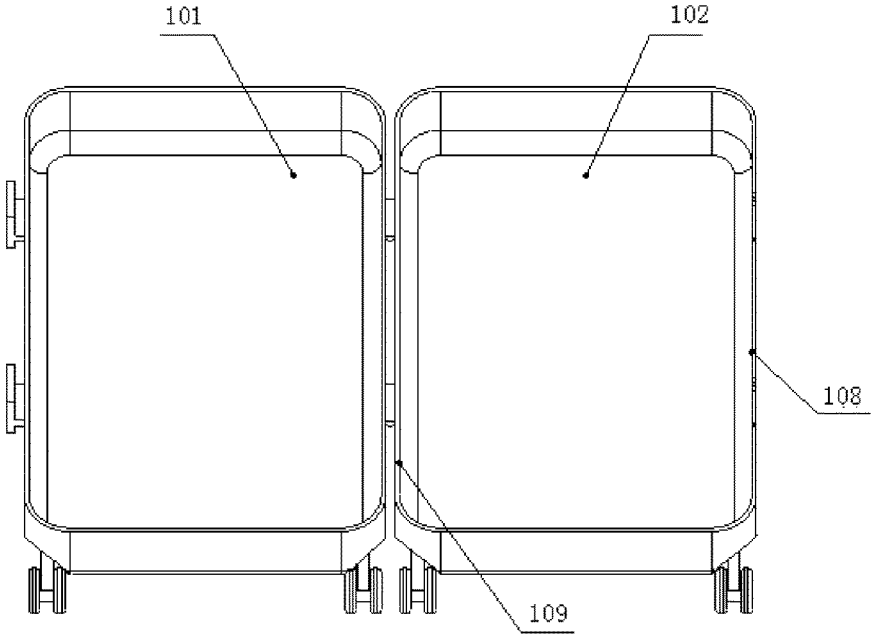
FIG. 2 is a structural schematic diagram of case bodies in FIG. 1.
Figure 3:
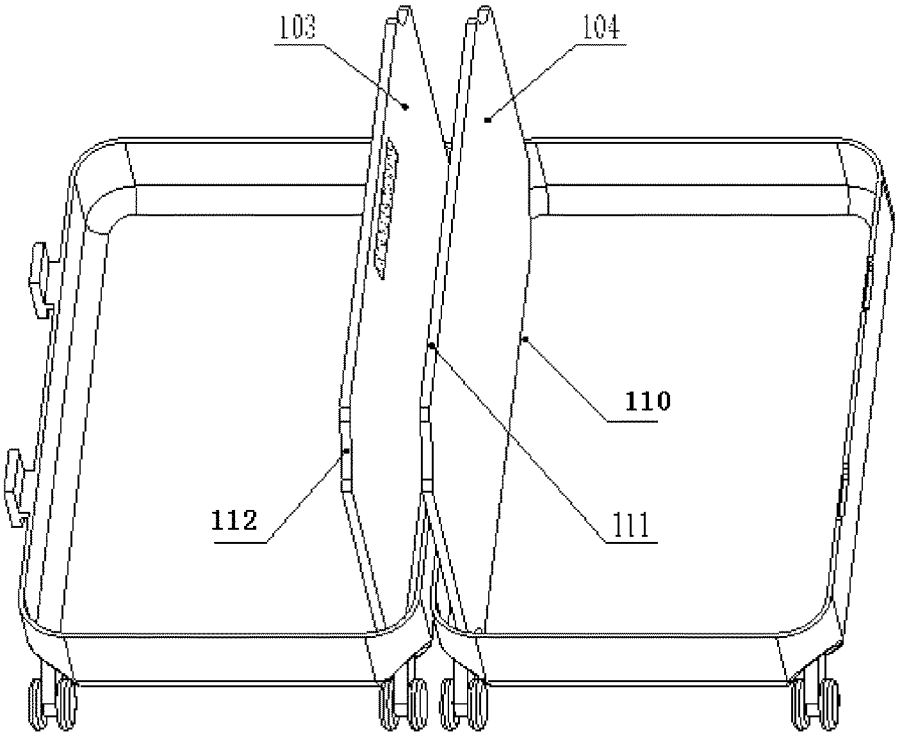
FIG. 3 is a structural schematic diagram of the case bodies and separating plates.
Figure 4:
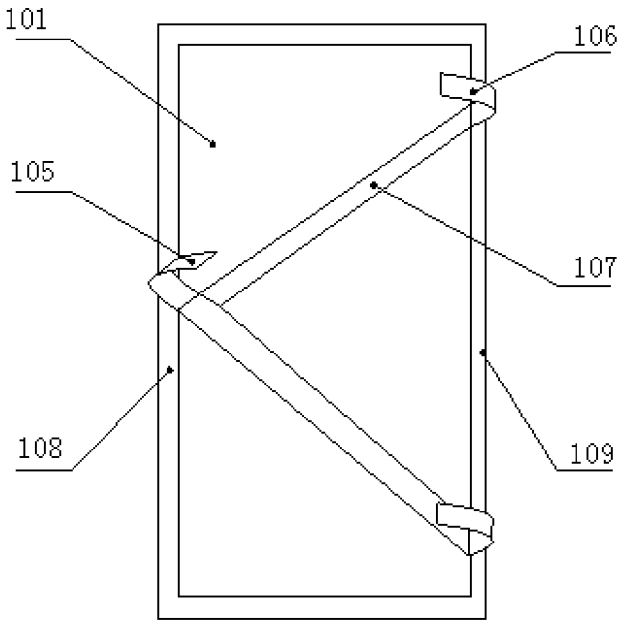
FIG. 4 is a structural schematic diagram of a connecting belt set.
Figure 5:
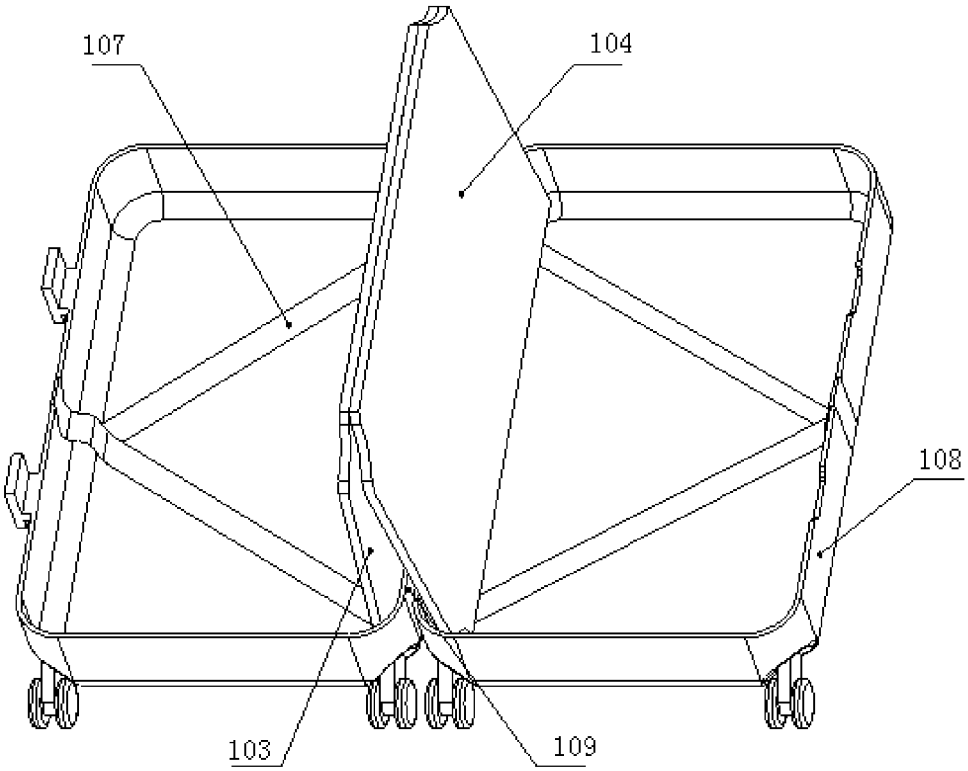
FIG. 5 is a structural schematic diagram of the separating plates in FIG. 1 when they are erected.
Figure 6:
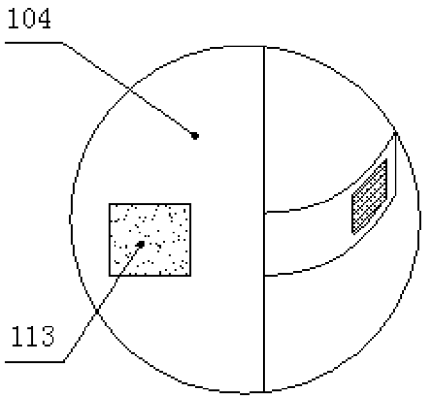
FIG. 6 is a schematic diagram showing connection by a Velcro in FIG. 1.
Figure 7:
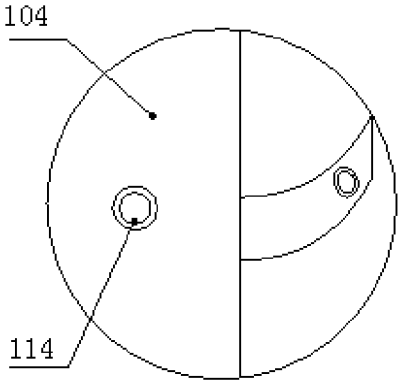
FIG. 7 is a schematic diagram showing connection by a button for a suitcase provided in Embodiment II of the present application.

Referring to FIG. 1 to FIG. 6, Embodiment I of the present application provides a suitcase including case bodies, separating plates, and connecting belt sets.

The case bodies include an upper case body 101 and a lower case body 102 which are rotationally connected, and the upper case body 101 and the lower case body 102 are capable of forming a closed storage chamber.

The case body includes a first sidewall 108 and a second sidewall 109 which are opposite to each other, and a rotation center line between the upper case body 101 and the lower case body 102 is provided on the second sidewall 109.

There are two connecting belt sets, and the lower case body 102 and the upper case body 101 are each provided with one set therein.

Each connecting belt set includes a connecting section 107, a first belt set 105, and a second belt set 106, and the separating plate is connected with the first sidewall 108 through the first belt set 105, and is connected with the second sidewall 109 through the second belt set 106.

The first belt set 105 and the second belt set 106 connect two sides of the separating plate with the first sidewall 108 and the second sidewall 109 respectively. The second sidewall 109 is region where rotating axis of the lower case body 101 and the lower case body 102 is located, and the first sidewall 108 is a sidewall on the case body directly facing the second sidewall 109. The upper separating plate 103 and the lower separating plate 104 both are fixed on the case bodies through connection with the second sidewall 109 and the first sidewall 108, facilitating removing or installing the separating plates.

Each connecting belt set further includes a connecting section 107, both the first belt set 105 and the second belt set 106 are connected or integrally formed with the connecting section 107. The connecting belt 107 is used for fixing or compressing luggage.

The connecting section 107 is used for tying the luggage into the suitcase. The luggage is pre-compressed into the storage chamber by the connecting section 107, and then the luggage is further compressed by the separating plate, preventing small items from moving freely in the storage chamber, at the same time, the utilization ratio of the storage chamber can be improved since loose and soft luggage is compressed in volume so that the case body is capable of storing more luggage items.

The connecting section 107 is in a shape of a triangle, the triangle has two endpoints located on the second sidewall 109 and another endpoint located on the first sidewall 108, and the first belt set 105 and the second belt set 106 are fixed at the endpoints respectively. The connecting belt set is fixed with the case body at the three endpoints of the triangle.

In the present embodiment, in each connecting belt set, the first belt set 105 includes one connecting belt and the second belt set includes two connecting belts. Three connecting belts of each connecting belt set are respectively provided at the three endpoints of the triangle formed by the connecting section 107.

In the present embodiment, the connecting section 107, the first belt set 105, and the second belt set 106 are formed integrally.

The connecting belt set is fixed with the case body only through three endpoint regions. The triangular area formed by the connecting section 107 is capable of reliably limiting the position of the luggage, and all of the three endpoints of the triangle are located on the second sidewall 109 and the first sidewall 108 so that the connecting section 107 requires a relatively short length.

In addition, the connecting section, the first belt set, and the second belt set further can be fixed together by sewing.

The separating plate and the case body are connected by the connecting belt set. The separating plates include an upper separating plate 103 and a lower separating plate 104. The upper separating plate 103 is provided in the upper case body 101, and the lower separating plate 104 is provided in the lower case body 102.

The storage chamber of the case bodies is divided into several spaces by the added upper separating plate 103 and lower separating plate 104, and the spaces after the division are more compact in volume, facilitating fixing the luggage. By fixing the separating plate with the connecting belt, it is convenient to adjust the position of the separating plate, and it is not needed to remove the lower separating plate 104 when packaging the luggage or taking out the luggage, which is more convenient. The upper case body 101 and the lower case body 102 are opened and closed by rotating, and the upper separating plate 103 and the lower separating plate 104 are respectively connected into the upper case body 101 and the lower case body 102 by the connecting belt sets, making it convenient for the user to take out the luggage from or put the luggage into the storage chamber.

The connecting sections 107 of two connecting belt sets are respectively provided in a gap between the upper separating plate 103 and the upper case body 101 and in a gap between the lower separating plate 103 and the lower case body 102. The separating plate and the luggage, located at two sides of the connecting section 107 respectively, do not interfere with each other when putting in the luggage.

The upper separating plate 103 and the lower separating plate 104 both are detachably connected with the first belt sets 105. In the present embodiment, the detachable connection is a mode of a Velcro 113 connection. Velcro is a common mode of detachable connection. The Velcro 113 is easily used and can be used repeatedly, facilitating adjusting the connection position.

One side of the separating plate which is far away from the second sidewall 109 is a first side edge 11, and one side of the separating plate which is close to the second sidewall 109 is a second side edge 110.

When the first belt set 105 is in a state of being separated from the separating plate, the upper separating plate 103 and the lower separating plate 104 can rotate, and the first side edge 111 of the upper separating plate 103 and the first side edge 111 of the lower separating plate 104 abut against each other during the rotation.

The upper separating plate 103 and the lower separating plate 104 both can be disconnected from the first belt sets 105 and movable connected with the case bodies through the second belt sets 106. When the upper separating plate 103 and the lower separating plate 104 are disconnected from the first belt sets 105, the first side edges 111 of the upper separating plate 103 and the lower separating plate 104 can rotate, and during the rotating process, the first side edges 111 of the upper separating plate 103 and the lower separating plate 104 abut against each other such that the two separating plates can remain erected, with the second sidewall 109 located between the two separating plates. The storage chamber is completely exposed when the two separating plates are erected, making it convenient for the user to put luggage into the upper case body 101 and the lower case body 102. By such a connection manner, the user can erect or lay down the separating plate 104 without changing his/her position with respect to the suitcase, facilitating operations. Meanwhile, the separating plates will not be flipped away from the storage chamber or be in contact with the ground.

The upper separating plate 103 and the lower separating plate 104 are provided with a loop surface and a hook surface of the Velcro 113 respectively. When the first side edge 111 of the upper separating plate 103 and the first side edge 111 of the lower separating plate 104 abut against each other, the loop surface and the hook surface are in contact with each other.

The upper separating plate 103 and the lower separating plate 104 are provided with corresponding Velcro 113. The two separating plates, when abutting against each other to erect, are fixed through adhesion of the loop surface and the hook surface of the Velcro 113, making it convenient to enable the two separating plates to maintain the erected state.

In the present embodiment, the separating plate is in a quadrilateral shape, and four corners of the separating plate are provided with a notch 112 respectively, facilitating providing the separating plates into the upper case body 101 and the lower case body 102.

Because a joint of the sidewalls of the case bodies may be provided with chamfers or rounded angles and an internal space of the case body may be occupied when universal wheels are provided at the bottom of the case body, all of the four corners of the separating plate are provided with the notch 112, making it easy to be adapted to spatial dimensions.

The beneficial effects of the present application are as follows: a connecting belt set is provided inside the case body and the separating plate is limited by the connecting belt set, such that it facilitates adjusting a position of the separating plate, and it is not needed to remove the separating plate 104 when packaging the luggage or taking out the luggage, which is more convenient. The upper case body 101 and the lower case body 102 are opened and closed by rotating, and the upper separating plate 103 and the lower separating plate 104 are respectively connected in the upper case body 101 and the lower case body 102 by the connecting belt sets, making it convenient for the user to take out the luggage from or put the luggage into the storage chamber. Furthermore, two separating plates, when opened, can be enabled to abut against each other and erect, such that a user can more easily adjust the state of the separating plate.

Embodiment II

Embodiment II of the present application provides a suitcase. Embodiment II differs from Embodiment 1 in that a first belt set and a second belt set in Embodiment II are connected with a separating plate by a button 114. The connection by a button is more precise, facilitating location.

Unless otherwise stated specifically, components, steps, numeric expressions, and numerical value described in those embodiments do not limit the scope of the present application.

The implementation principle of and the technical effects produced by the device provided in the embodiments of the present application are the same as those of the above-mentioned embodiments. For simplifying the description, anything the device embodiment does not mention may be known by referring to corresponding contents in the foregoing embodiments.

In all examples illustrated and described herein, any specific value should be interpreted as only being exemplary, rather than limiting. Therefore, other examples of exemplary embodiments may have different values.

It should be noted that similar reference signs and letters represent similar items in the following drawings, therefore once a certain item is defined in one drawing, it is not needed to be further defined or explained in subsequent drawings.

The foregoing descriptions are only preferable embodiments of the present application, and not used to limit the present application. For those skilled in the art, various modifications and variations may be made to the present application. Any amendments, equivalent replacements, improvements and so on should be covered by the scope of protection of the present application, without departing from the spirit and principle of the present application.

The invention claimed is:

1. A suitcase, comprising case bodies and separating plates, wherein the case bodies comprise an upper case body and a lower case body which are rotationally connected, the upper case body and the lower case body are capable of forming a storage chamber, the separating plates comprise an upper separating plate and a lower separating plate, the upper separating plate is provided in the upper case body, and the lower separating plate is provided in the lower case body;

in a state of the case bodies being open, the upper separating plate is capable of rotating toward a direction of the lower case body, and the lower separating plate is capable of rotating toward the upper case body;

the upper and lower separating plates are connected to the upper and lower case bodies respectively by two connecting belt sets;

the case bodies comprise a first sidewall and a second sidewall which are opposite to each other, a rotation center line between the upper case body and the lower case body is provided on the second sidewall, each of the connecting belt sets comprises a first belt set and a second belt set, each of the upper and lower separating plates is detachably connected with the first sidewall through the first belt set of its respective connecting belt set, and each of the upper and lower separating plates is rotationally connected with the second sidewall through the second belt set of its respective connecting belt set;

one side of each of the upper and lower separating plates far away from the second sidewall is a first side edge, and one side of each of the upper and lower separating plates close to the second sidewall is a second side edge;

when the first belt sets of the connecting belt sets are in a state of being separated from the upper and lower separating plates, the upper separating plate and the lower separating plate are capable of rotating, and the first side edge of the upper separating plate and the first side edge of the lower separating plate abut against each other during rotation such that the upper and lower separating plates can remain erected;

the upper separating plate and the lower separating plate are respectively provided with a loop surface and a hook surface of a hook-and-loop fastener, and when the first side edge of the upper separating plate and the first side edge of the lower separating plate abut against each other, the loop surface and the hook surface are in contact with each other; and each of the connecting belt sets further comprises a connecting section, the first belt set and the second belt set are both connected or integrally formed with the connecting section, and the connecting section is used for fixing or compressing items within the suitcase.

2. The suitcase according to claim 1, wherein each of the upper separating plate and the lower separating plate is detachably connected with the second belt set of its respective connecting belt set.

3. The suitcase according to claim 2, wherein the detachable connection is a hook-and-loop fastener or a button connection.

4. The suitcase according to claim 2, wherein the connecting section of each of the connecting belt sets is in a shape of a triangle, the triangle has two endpoints located on the second sidewall and another endpoint located on the first sidewall, and the first belt set and the second belt set of its respective connecting belt set are fixed at the endpoints respectively.

5. The suitcase according to claim 4, wherein the connecting belt set of each of the connecting belt sets is fixed with the case bodies at three endpoints of the triangle.

6. The suitcase according to claim 2, wherein the connecting sections of the two connecting belt sets are provided between the upper separating plate and the upper case body and between the lower separating plate and the lower case body respectively.

7. The suitcase according to claim 1, wherein the upper and lower separating plates are in a quadrilateral shape, and four corners of each of the upper and lower separating plate are provided with a notch respectively.

* * * * *